US007190332B1

(12) United States Patent
Webb et al.

(10) Patent No.: US 7,190,332 B1
(45) Date of Patent: Mar. 13, 2007

(54) ACOUSTICALLY ACTIVATED MARKETING DEVICE

(75) Inventors: Nicholas Webb, Hole Farm Cottage, Chilsham Lane, Bodle Street Green, Near Herstmon Ceux, East Sussex (GB) BN27 4QJ; Stephen Philip Rowe, Hampshire (GB); John Mansbridge, Hampshire (GB)

(73) Assignees: Roke Manor Research Limited, Romsey (GB); Nicholas Webb, Near Herstmon Ceux (GB)

( * ) Notice: Subject to any disclaimer, the term of this patent is extended or adjusted under 35 U.S.C. 154(b) by 0 days.

(21) Appl. No.: 09/763,360

(22) PCT Filed: Dec. 21, 1999

(86) PCT No.: PCT/GB99/04354

§ 371 (c)(1),
(2), (4) Date: Aug. 9, 2001

(87) PCT Pub. No.: WO00/38159

PCT Pub. Date: Jun. 29, 2000

(30) Foreign Application Priority Data

Dec. 21, 1998 (GB) ..... 9828101.7
Apr. 6, 1999 (GB) ..... 9907626.7

(51) Int. Cl.
*G09G 3/00* (2006.01)
*G09G 3/18* (2006.01)

(52) U.S. Cl. ..... 345/30; 345/38

(58) Field of Classification Search ..... 345/87, 345/30–40, 1, 107, 835, 85, 90, 93, 104; 340/825.35, 825.54, 825.36, 286.01; 40/1.5; 348/552, 730, 473; 375/130; 455/154.1, 455/158.1–158.5
See application file for complete search history.

(56) References Cited

U.S. PATENT DOCUMENTS 4,637,148 A * 1/1987 Barlow ..... 40/1.5
4,980,679 A * 12/1990 Klaubert ..... 345/50
5,212,551 A * 5/1993 Conanan ..... 348/484
5,264,822 A * 11/1993 Vogelman et al. ..... 340/286.01
5,572,201 A * 11/1996 Graham et al. ..... 340/902
5,703,795 A * 12/1997 Mankovitz ..... 715/721
5,708,478 A * 1/1998 Tognazzini ..... 348/552
5,774,170 A * 6/1998 Hite et al. ..... 725/34
5,914,671 A * 6/1999 Tuttle ..... 340/10.42
5,949,492 A * 9/1999 Mankovitz ..... 348/473
5,973,252 A * 10/1999 Hildebrand ..... 84/603
6,002,393 A * 12/1999 Hite et al. ..... 345/719
6,147,713 A * 11/2000 Robbins et al. ..... 348/555

(Continued)

FOREIGN PATENT DOCUMENTS

GB 2 149 554 * 6/1985
GB 2343774 5/2000

*Primary Examiner*—Vijay Shankar
(74) *Attorney, Agent, or Firm*—Crowell & Moring LLP

(57) ABSTRACT

An acoustically activated marketing for displaying predefined information in response to predefined data being received. The device is obtained from a retailer and worn as a badge while at the cinema or while listening to the radio or TV. When a specific advertisement is broadcast, the badge interprets part of the sound track and activates the display on the badge. The displayed information may be an advertisement or a message. The predefined data may be broadcast by a commercial broadcasting means, such as a television or radio.

15 Claims, 2 Drawing Sheets

U.S. PATENT DOCUMENTS 6,177,880 B1 * 1/2001 Begum ..... 340/5.9
6,252,564 B1 * 6/2001 Albert et al. ..... 345/1.3
6,389,055 B1 * 5/2002 August et al. ..... 375/130
2001/0006369 A1 * 7/2001 Ely ..... 341/20
2001/0035917 A1 * 11/2001 Satake et al. ..... 348/730
2003/0025738 A1 * 2/2003 Polgar et al. ..... 345/835

* cited by examiner

ACOUSTICALLY ACTIVATED MARKETING DEVICE

This application claims the priority of British patent documents 9907626.7, filed Apr. 6, 1999 and 9828101.7, filed Dec. 21, 1998 (PCT No.: PCT/GB99/04354), the disclosures of which are expressly incorporated by reference herein.

The present invention relates to an acoustically activated marketing device.

The consumer obtains the device from a retailer, and wears the device as a badge while at the cinema or while listening to the radio or TV. When a specific advert is broadcast the badge interprets part of the sound track and activates the display on the badge.

According to the present invention the apparatus for displaying information includes a display means and an activation means. The activation means is coupled to the display means such that upon reception of predefined data, the activation means causes the display means to display predefined information. The predefined data may be transmitted by an acoustic signal, which may be digitally modulated.

According to a further aspect of the present invention said predefined data is broadcast by a commercial broadcasting means, which may be a television broadcasting a radio broadcasting means.

According to yet a further aspect of the present invention, the apparatus further includes programming means for programming the predetermined data and the predefined information. The display means may be a liquid crystal display, and the activation means may be an application specific integrated circuit.

The apparatus further includes a microphone means, an analogue to digital interface means, a programmable digital processor and a battery, which may be a button cell type battery.

According to an aspect of the present invention, the predefined information may be an advertisement, or a message.

According to a further aspect of the present invention, there is provided a method for displaying information, including the steps of: receiving data, comparing the received data with predefined data, and when the received data matches the predefined data, displaying predefined information.

According to a further aspect of the present invention the data may be transmitted by an acoustic signal, which may be digitally modulated.

According to yet a further method aspect, the acoustic signal is part of a commercial television or radio broadcast.

BRIEF DESCRIPTION OF THE DRAWINGS

While the principal advantages and features of the invention have been described above, a greater understanding and appreciation of the invention may be obtained by referring to the drawings and detailed description of the preferred embodiment, presented by way of example only, in which.

DETAILED DESCRIPTION OF THE DRAWINGS

Figure 1:
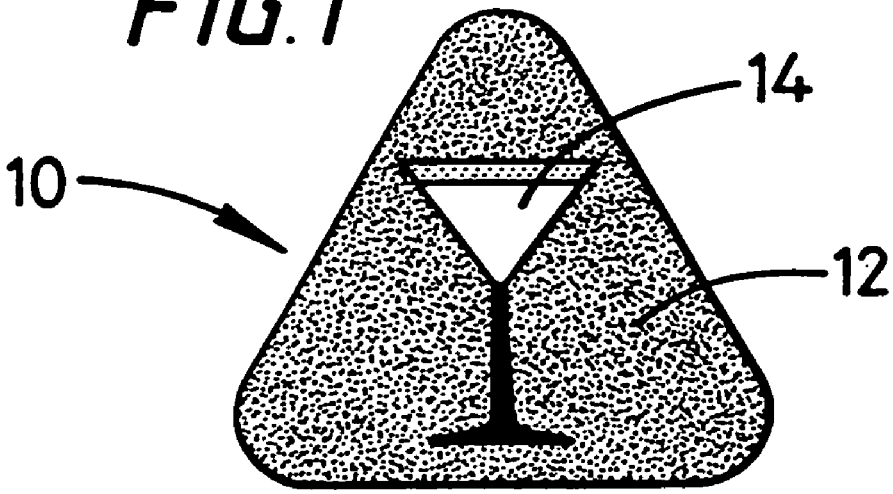
FIG. 1 shows the display means of an acoustically activated marketing device according to one aspect of the present invention.
Figure 3:
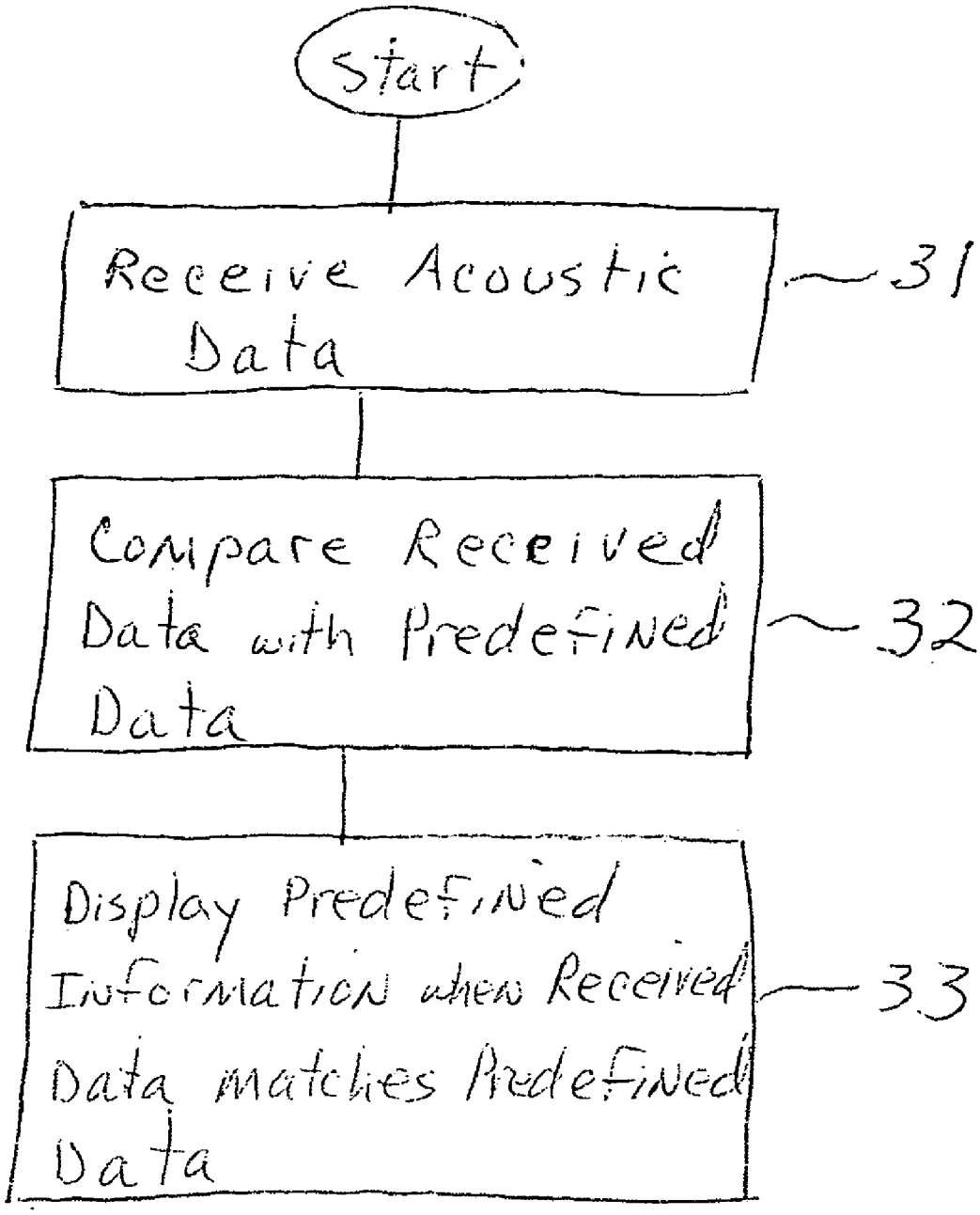
FIG. 3 is a flow chart which illustrates the method according to the invention.

In FIG. 1 an acoustically activated marketing device (10) is shown comprising a low-cost display (12). The display (12) may be a liquid crystal display. The device (10) operates such that upon reception of predefined data, the display (12) displays predefined information. (See FIG. 3.) The acoustically transmitted data received in step 31 are compared with predefined data in step 32, and when the received data matches the predefined data, predefined information is displayed in step 33. This information may be an advertisement such as a cocktail glass (14) or a message indicating that a prize has been won.

The device can be configured such that different data triggers different messages. For example, data X may trigger a message that indicates a prize has been won, while data Y may trigger a message that indicates that no prize has been won.

Alternatively, different badges can be configured to respond differently to the same data. For example, upon reception of the same data, one badge may indicate that a prize had been won, while another badge may not.

Figure 2:
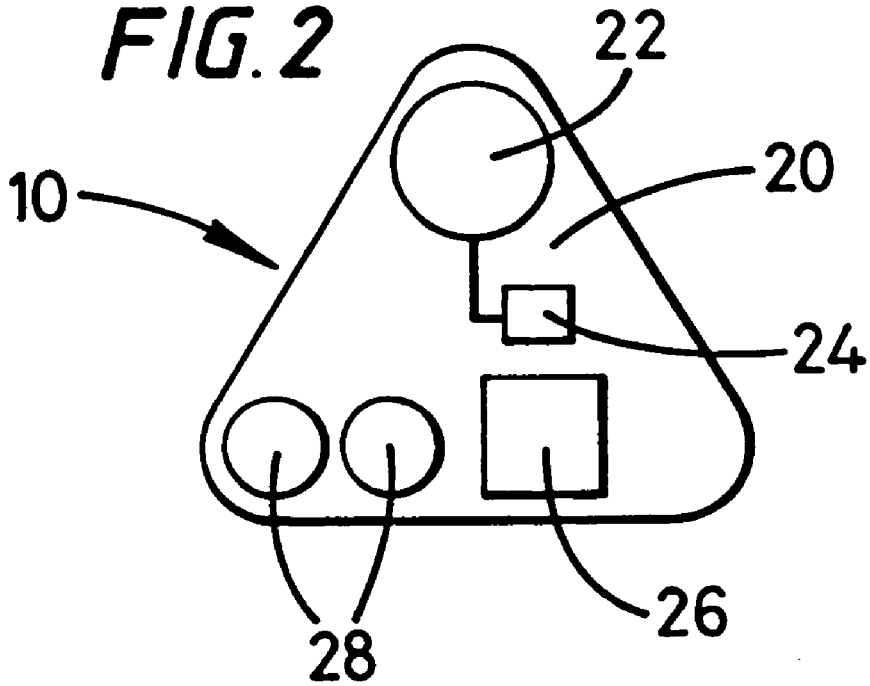
FIG. 2 shows the electronic layout of an acoustically activated marketing device according to one aspect of the present invention.

In FIG. 2 the electronics layout (20) of an acoustically activated marketing device (10) is shown. In this aspect of the present invention the electronics layout includes a microphone element (22) connected to an A/D interface (24). The microphone elements operate to detect a predefined acoustic signal. The device (10) further includes a programmable digital processor (26) which allows for a variety of acoustic signals and corresponding display information to be programmed into the device. Thus a single device can be mass-produced and then programmed in the factory to satisfy a variety of different customer's needs.

The device (10) further comprises a battery source (28). In this embodiment of the present invention the battery source is a button type battery.

As will be appreciated, when the predefined information is displayed the consumer may be in an area of high noise, for example; in the midst of conversation in a cinema or at home, or when driving in a car. This noise may mask the predefined data and prevent the display means from being activated. Ideally, this should not be greater than 1 non-activation out of 10 or 20 occasions.

As will be appreciated, while the consumer is wearing the badge, it will be subject to many different sources of noise, for example; conversation, music and car noise. These could, by chance, contain a sequence of sounds that are sufficiently like the predefined signal to trigger the device. The probability of this type of 'false alarm' occurring can be reduced by increasing the complexity of the predefined data, but this may be at the expense of battery life or badge cost. Ideally, less than 1 in 100 badges should be unintentionally activated during their lifetimes.

The required operating lifetime of the badge is expected to be application-dependent. Long operating lifetimes will require higher cost batteries or lower power circuits.

To minimise the production cost, an application specific integrated circuit (ASIC) can be developed. To reduce packaging costs the ASIC can be directly mounted on the printed circuit board and then protected from the atmosphere by a layer of plastic. For this type of ASIC to be viable, large production runs will be necessary. The requirement for such runs will make it more difficult to adapt the ASIC to a different application. Some degree of programmability may be possible, however this may require the use of a more expensive production process.

The foregoing disclosure has been set forth merely to illustrate the invention and is not intended to be limiting. Since modifications of the disclosed embodiments incorporating the spirit and substance of the invention may occur to persons skilled in the art, the invention should be construed to include everything within the scope of the appended claims and equivalents thereof.

The invention claimed is:

1. Apparatus for selectively displaying predetermined information, comprising:

means for receiving an acoustically propagated signal derived from commercially broadcast information which is transmitted by one of radio and television;

means for comparing a content of said acoustically propagated signal with a stored predefined signal content;

an output unit for generating a human intelligible output; and means for causing said output unit to generate a predetermined information signal upon detection of a match between said acoustically propagated signal and said predefined signal content, said predetermined information signal being generated in one of visually and audibly detectable form.

2. A method for displaying information, said method comprising:

embedding a predetermined acoustic signal within a soundtrack to be emitted by an entertainment device;

the entertainment device emitting the predetermined acoustic signal, embedded in said soundtrack, in audible form;

an acoustically activated device receiving said predetermined acoustic signal and comparing it with a predefined signal that is stored in the acoustically activated device, and upon said predetermined acoustic signal matching said predefined signal, said acoustically activated device displaying predefined information that is stored in the acoustically activated device;

wherein the entertainment device comprises one of:

a radio receiver;

a television receiver; and a cinema system.

3. A method of displaying information, comprising:

a person wearing a badge while listening to one of cinema, radio and television program material, said badge having an acoustic detector, processor means for processing information received from said acoustic detector, and means for displaying predetermined visual indicators;

upon determination by said processor means that said acoustic detector has received predefined acoustic information, said processor means causing said display means to display a predetermined visual indicator associated with said predefined acoustic information.

4. Apparatus for displaying information, said apparatus comprising:

display means; and activation means coupled to said display means, for causing said display means to display predefined information in response to reception of predefined acoustically propagated data from a signal broadcast by a commercial broadcast source;

wherein said commercial broadcast source comprises one of a commercial radio broadcaster and a commercial television broadcaster.

5. Apparatus as claimed in claim 4, wherein said acoustically propagated data are incorporated in an acoustic signal onto which said acoustically propagated data have been digitally modulated.

6. Apparatus as claimed in claim 4, further comprising programming means for programming said predefined data and said predefined information.

7. Apparatus as claimed in claim 4, wherein said display means is a liquid crystal display.

8. Apparatus as claimed in claim 4, wherein said activation means is an application specific integrated circuit.

9. Apparatus as claimed in claim 4, wherein said apparatus further includes a microphone, an analog to digital interface, a programmable digital processor and a battery.

10. Apparatus as claimed in claim 4, wherein predefined information is an advertisement.

11. Apparatus as claimed in claim 4, wherein said predefined information is a message.

12. The apparatus as claimed in claim 4, wherein said predefined information comprises a preset visually discernable message or symbol which differs from "said predefined acoustically propagated data".

13. A method for displaying information, said method comprising:

receiving an acoustically propagated signal;

comparing said received acoustically propagated signal with a predefined signal; and when said received acoustically propagated signal matches said predefined signal, displaying predefined information;

wherein said received acoustically propagated signal is commercially broadcast via one of radio and television transmission.

14. The method as claimed in claim 13, wherein said predefined signal and said predefined information are predefined by a computer program.

15. The method as claimed in claim 14, wherein said commercially broadcast acoustic signal is an advertisement.

* * * * *